United States Patent [19]

Nobis et al.

[11] Patent Number: 5,014,412

[45] Date of Patent: May 14, 1991

[54] STRIP CASTING INSTALLATION WITH ROTARY HEARTH FURNACE AND METHOD FOR PRODUCING HOT-ROLLED STEEL STRIP THEREFROM

[75] Inventors: Dieter Nobis, Neuss; Friedrich Hollmann, Grevenbroich; Horst Düster, Velbert, all of Fed. Rep. of Germany

[73] Assignee: SMS Schloemann-Siemag Aktiengesellschaft, Dusseldorf, Fed. Rep. of Germany

[21] Appl. No.: 370,458

[22] Filed: Jun. 23, 1989

[30] Foreign Application Priority Data

Jun. 23, 1988 [DE] Fed. Rep. of Germany ..... 3821188

[51] Int. Cl.[5] ..... B21B 1/46; B21B 13/22; B22D 11/12

[52] U.S. Cl. ..... 29/527.7; 72/202

[58] Field of Search ..... 29/527.7, 527.6; 72/39, 72/40, 200, 201, 202, 203; 164/417, 476

[56] References Cited

U.S. PATENT DOCUMENTS

| | | | |
|---|---|---|---|
| 3,705,967 | 12/1972 | Bobart et al. | 219/10.41 |
| 4,452,061 | 6/1984 | Numano et al. | 72/202 X |
| 4,675,974 | 6/1987 | Connolly | 29/527.7 |
| 4,698,897 | 10/1987 | Frommann et al. | 29/527.7 |

FOREIGN PATENT DOCUMENTS

| | | | |
|---|---|---|---|
| 20333543 | 12/1970 | France . | |
| 55-45530 | 3/1980 | Japan | 29/527.7 |
| 56-74304 | 6/1981 | Japan | 72/202 |
| 58-100904 | 6/1983 | Japan | 29/527.7 |
| 60-180601 | 9/1985 | Japan . | |
| 60-262924 | 12/1985 | Japan . | |
| 61-176402 | 8/1986 | Japan | 29/527.7 |
| 62-89502 | 4/1987 | Japan | 29/527.7 |
| 62-187505 | 8/1987 | Japan . | |
| 89/08512 | 9/1989 | PCT Int'l Appl. . | |
| 1055868 | 1/1967 | United Kingdom . | |
| 2129723 | 5/1984 | United Kingdom . | |
| 2167170 | 5/1986 | United Kingdom . | |

*Primary Examiner*—E. Michael Combs
*Attorney, Agent, or Firm*—Toren, McGeady & Associates

[57] ABSTRACT

An invention is directed to a method and an installation for producing a hot-rolled steel strip from continuously cast primary material in consecutive work steps, wherein the primary material is brought to hot rolling temperature after solidification and is inserted into a rolling mill for rolling out into a finished strip, wherein the primary material is coiled after reaching the hot rolling temperature, is stored intermediately in a rotary hearth furnace, and is recalled, as needed, uncoiled and rolled out to form a finished strip, the intermediate storage being effected immediately prior to entering the finishing train, the coils being preferably stored intermediately in a horizontal position and with a horizontal coiling axis, a subsequent heating being effectable during the intermediate storage.

13 Claims, 4 Drawing Sheets

STRIP CASTING INSTALLATION WITH ROTARY HEARTH FURNACE AND METHOD FOR PRODUCING HOT-ROLLED STEEL STRIP THEREFROM

BACKGROUND OF THE INVENTION

The invention relates to a method and an installation for producing a hot-rolled steel strip from continuously cast primary material in consecutive work steps, wherein the primary material is brought to hot roll temperature after solidification and is inserted into a rolling mill for rolling out into a finished strip.

A method which is known from German Offenlegungsschrift Pat. No. 32 41 745 provides that a strip-shaped cast strand be wound into a coil immediately after leaving the casting machine and passing the transverse cutting device and then, after heating to rolling temperature, uncoiled again and fed to a rolling mill for rolling out into final cross sections. A disadvantage of this known installation is that it is difficult to heat wound up coils and a very long time at a great cost in energy and operation costs is required for this.

Known strip casting installations usually use tunnel furnaces in order to bring the primary material to the desired hot rolling temperature, wherein, however, the material strands are not coiled. A substantially lower expenditure of energy is required compared to strip coiling. In multiple-strand installations, holding furnaces must be used in any event because of the resulting long transportation distances.

Bogie hearth continuous furnaces, hoisting hearth or car-bottom furnaces are primarily taken into consideration as holding furnaces; however, all of these have various disadvantages. With the use of a bogie hearth continuous furnace, it is not possible to charge and discharge coils at different times, since when discharging a bogie hearth without another bogie hearth moving up behind it, a gap occurs which is not protected from heat radiation. The charging and discharging must therefore always be effected simultaneously. In addition, the empty bogie hearths must be brought back from the discharge side to the charge side. A subsequent heating of the car, or, at any event, of the ceramic benches, is required in order to avoid black spots (so-called skid marks). During disturbances in the rolling mill train, the coils present at the coil winding station cannot be received by the furnace. There must be an additional storage furnace for storing the coils. Both doors must be opened simultaneously during the charging and discharging of a bogie hearth, which leads to higher heat losses.

A hoisting hearth furnace requires a plurality of separately driven hoisting hearth beam systems (walking-beam type systems) in order to enable a separate charging and discharging of coils. In the event of a disturbance in the rolling mill, no coils can be received by the furnace for storage. A second furnace installation is also required in this case if coils are to be stored.

A car-bottom furnace can receive one or more coils depending on the design. If the storage capacity must be the same as the ladle contents, a plurality of car-bottom furnaces are required. The disadvantage in a plurality of furnaces is that the traveling distances to the uncoilers vary and, because of this, there is no uniformity of temperature of the coils.

SUMMARY OF THE INVENTION

Therefore, it is an object of the present invention to provide a method for producing hot-rolled steel strips and a continuous casting installation with hot-strip rolling mill arranged downstream, so that the aforementioned disadvantages can be avoided and the difficulties can be eliminated and so that work may be carried out while adapting to different production quantities of the individual strands in multiple-strand installations, as well as during operating disturbances, in an economical manner, i.e. with high work loads, and in which, in particular, relatively low investment costs are required.

Pursuant to this object, and others which will become apparent hereafter, one aspect of the present invention resides in the primary material being wound into coils after reaching the hot rolling temperature, intermediately stored in a rotary hearth furnace and recalled, as needed, uncoiled and rolled out to form finished strips.

In an advantageous construction of the invention, the intermediate storage is effected immediately prior to the entrance into the finishing train. The temperature distribution is accordingly made uniform even during only very short holding times, which has advantageous results for the rolling process.

According to another embodiment of the invention, the coils are stored intermediately in a horizontal position or with a horizontal coiling axis, so that a particularly simple charging is provided, accompanied by the use of known and proven manipulators. On the other hand, it is also possible to store the coils intermediately with preferably vertical coiling axis or in any other coil position.

It is advisable that heat be supplied during the intermediate storage. In this way, heat losses at the surface can be compensated for by means of subsequent heating and ideal rolling conditions are accordingly provided. The horizontal position of the coils is particularly effective in this instance.

For the strip casting installation with continuous rolling mill arranged downstream, the object is met in that a coiler and a rotary hearth furnace as a second furnace, as well as an uncoiler, are arranged between the first furnace and the finishing train. In a particularly advantageous manner, a plurality of coils which are formed from parallel primary material strands can be stored intermediately in only one rotary hearth furnace. Accordingly, considerable investment costs can be saved.

According to further embodiment of the invention, the rotary hearth furnace is integrated in the production line and comprises a charging and discharging location in each instance. Space is saved with this step and an emergency storage during operating disturbances is simultaneously provided.

In addition, however, the rotary hearth furnace can be arranged adjacent to the production line and be provided with only one charging and discharging location, so that the heat losses are prevented to great advantage. The charging device is arranged, optionally, in the inner circle of the furnace with the advantage of an additionally reduced space requirement.

In an additional embodiment, which is very suitable for many possibilities of use, the rotary hearth furnace has an outer diameter of approximately 13.5 m and is designed for receiving 10 coils. Other design data are given as a function of the ladle contents of the strip casting installation. The strip casting installation is generally designed as a double-strand installation/two single-strand strip casting installations and is equipped with two coilers arranged downstream of the furnaces.

In another embodiment of the invention, the first furnace is constructed as a shortened roller hearth furnace, without a soaking zone, comprising induction heatino arranged upstream. In this way, the entire overall length of the installation can be greatly reduced, since the roller hearth furnace only has a length of approximately 80 m with a heating zone and a short buffer zone. The induction heating requires little space and introduces the absent heat quantities into the strip within the briefest time in a very advantageous manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
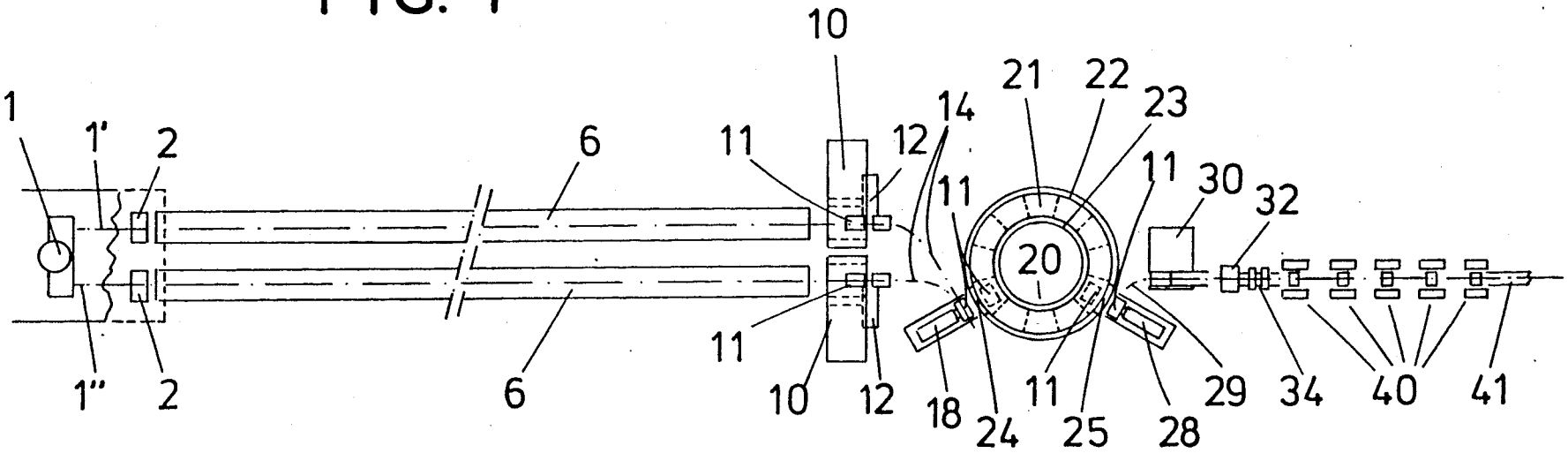
FIG. 1 shows a basic sketch of a two-strand strip casting installation, according to the invention, in a top view comprising a roller hearth furnace and arrangement of a rotary hearth furnace approximately in the casting or pitch line.

In FIG. 1, a strip casting installation with two strands 1', 1'' is designated by 1, a transverse cutting device 2, e.g. a flame-cutting machine or shears, being arranged downstream of the strip casting installation 1 for the purpose of dividing the cast strips 1', 1'' leaving the casting installation 1 at a speed of approximately 6–7 m/min, at most 8 m/min, into partial pieces of the same length of e.g. 65 m. The individual partial lengths of the strips are then stored intermediately one after the other in two roller hearth furnaces 6 of approximately 150 m length and brought to a homogenous hot rolling temperature of approximately 1050 to 1100 degrees Celsius. The roller hearth furnaces 6 comprise, e.g. on the input side, a 3 m long unheated foldable hood adjoining a 70 m long heating zone, a 65 m long soaking zone, and a buffer zone of 12 m. The partial lengths leaving the furnaces 6 are wound up into coils 11 in a coiler or two coilers 10. The coiling speed is approximately 2–3 m/s. The coils 11 have a coil weight of between 22 and 27 tons according to the strip width between 1100 and 1350 mm at a thickness of 40 mm and a strip length of 65 m. The coils 11 are fed to a charging device 18 from coil transferring stations 12 via a transporting system 14, which charging device 18 brings the coils 11 into a rotary hearth furnace 20, according to the invention.

The rotary hearth furnace 20 is advantageously arranged in the line between a two-strand strip casting machine (or a plurality of single-strand strip casting installations) and the hot-rolled wide strip rolling mill 40. It is substantially designed as a storage furnace or soaking furnace and comprises e.g. approximately 10 to 25 annularly distributed storage places 21. The annular furnace 20 comprises a fire-proof insulation on all sides, wherein closable charging openings 24, 25, in the present instance a charging 24 and discharging opening 25, are preferably provided in the outer and/or inner wall 22, 23. The storage places 21 within the furnace 20 are movable on a circular path between the stationary outer and inner wall 22, 23 at desired speed and in a desired direction. A coil 11 is removed via discharging device 28 in each instance and fed to an uncoiler 30 by means of a suitable coil transferring device 29. The transfer can be effected as desired, e.g. also by means of a discharging device 28 constructed so as to be swivelable between the discharging position and the uncoiler 30. The uncoiled strip is then conveyed to the finishing rolling mill train 40 in a known manner via shears 32 and a scale-breaking installation 34, wherein the uncoiled strip is rolled out in the finishing rolling mill train 40 to the final rolled thickness to form the finished strip 41. After leaving the last rolling mill stand of the finishing train 40 with a delivery temperature of approximately 860 degrees Celsius, the finished strip 41 passes through a cold rolling train in a known manner to be coiled up subsequently by an underground coiler (not shown) at a temperature of approximately 560 degrees Celsius.

The charging and discharging of coils 11 can be effected independently from one another with respect to time. During trouble-free operation of the rolling installation 40, the coils 11 only pass through a partial area of the furnace 20, corresponding to the required holding time between the charging and discharging stations 18, 28. If disturbances occur in the rolling mill train 40, additional coils 11 can be stored intermediately. When putting the rolling mill train 40 back into operation again, the coils 11 can be removed from the furnace 20 in desired sequence. The transporting of the coils 11 through the furnace 20 is effected on a hearth which is prepared for this purpose. This hearth has a furnace room temperature and prevents black spots, i.e. so-called skid marks. During the holding time, a temperature compensation takes place in the coil. The furnace 20 can be designed in an advantageous manner for a scale-resistant heating.

Figure 2:
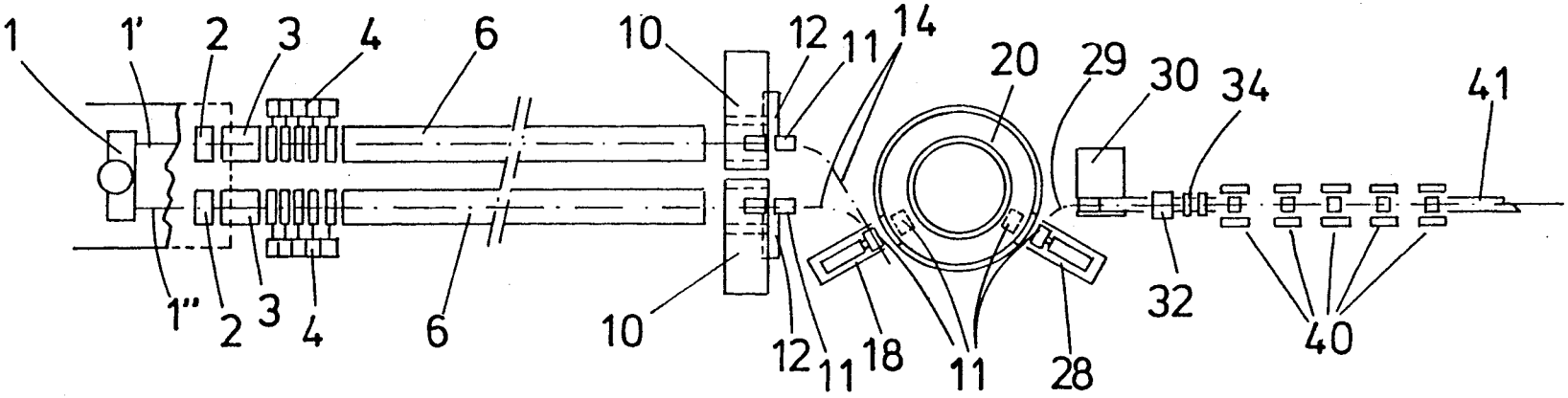
FIG. 2 hows a basic sketch of the installation, according to the invention, as in FIG. 1, but with a shortened roller hearth furnace.

The furnace combination according to FIG. 2 has the advantage that the total length of the furnaces 6, 20 in the production line is shorter than a roller hearth furnace 6 according to FIG. 1, since the soaking zone can be dispensed with. The length of the roller hearth furnaces 6 in this instance is approximately 80 m with a strip length of 65 m, consisting of a heating zone of 68 m and a buffer zone of 12 m, which is required for the subsequent method steps. The strips 1', 1'' run through the furnaces 6 at casting speed during the subsequent heating. When the strip end reaches the roller hearth furnace 6, it is conveyed out of the respective furnace 6 at coiling speed, i.e. at approximately 2–3 m/s, and wound into coils 11 in the coilers 10. The holding time of a strip in the roller hearth furnace 6 decreases continuously from the tip of the strip to the end of the strip. The front portion of the strip remains in the furnace 6 during the entire casting time and therefore has a higher temperature. As the holding time decreases, a partial length of the strip may possibly not be brought to the temperature level required for the subsequent rolling process. Foldable hoods 3 are provided for removing residual strip pieces and so as to reduce the heat losses.

An induction heater 4 is provided to introduce the absent heat quantities into the strip. The heating power of the induction heater 4 is raised corresponding to the absent amount of heat, wherein the switch-on time is calculated. The data for this are the measured strip temperature, the casting speed and the furnace room temperature. The individual inductors 4 are switched off when the end of the strip has passed them. A temperature compensation in the coil 11 to the required temperature profile can be effected in the rotary hearth furnace 20 arranged downstream. The arrangement and manner of operation of the rotary hearth furnace 20 and of the units arranged prior to and subsequent to the latter correspond to the description of FIG. 1. However, as an alternative for a sufficient temperature compensation, the roller hearth furnaces 6 can also be lengthened, wherein the individual controlled zones move alternately to heating and soaking temperature, respectively.

Figure 3:
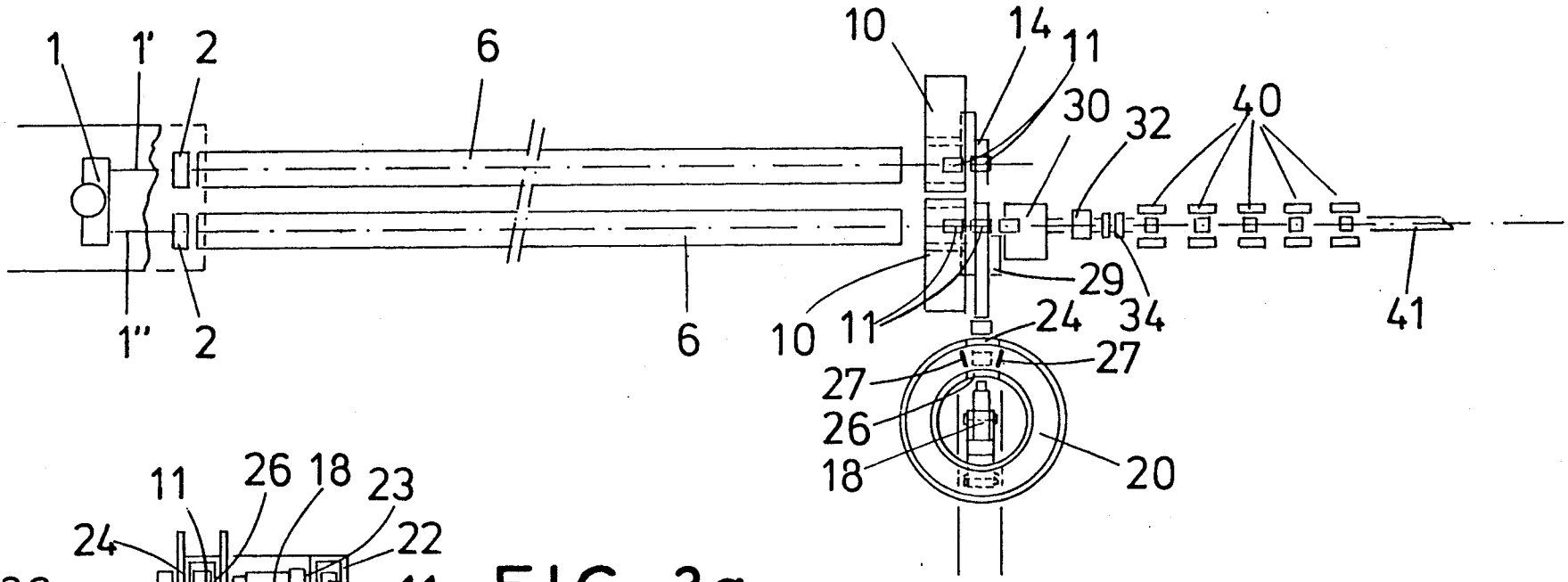
FIG. 3 shows a strip casting installation, according to the invention, in a top view comprising a rotary hearth furnace in vertical arrangement relative to the casting or pitch line.
Figure 3A:
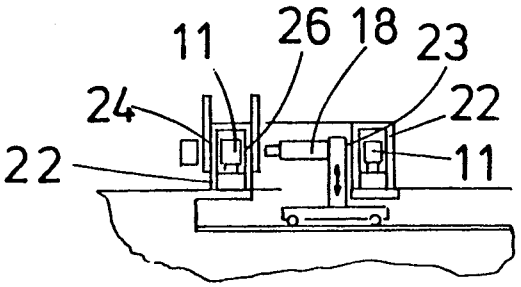
FIG. 3*a* shows a charging device arranged centrally in the rotary hearth furnace as a detail from FIG. 3, shown in a side view in section in a schematic manner.

The rotary hearth furnace 20 can also be arranged adjacent to the production line of the strip casting installation according to FIG. 3 and, in so doing, serves as a pure coil storage furnace. The charging or discharging of the coils 11 is effected at the same location via the charging opening 24. The possibility of keeping the distances of the transporting system 14 short is provided by means of this. As can also be seen particularly from FIG. 3*a*, closable openings having a door 24, 26 in each instance are provided for the charging device 18 in the outer and inner wall 22, 23 of the rotary hearth furnace 20, the charging device 18 being arranged in the inner circle of the furnace. In addition, two slides 27, which close the rest of the furnace space when charging, are arranged in the furnace 20. This measure keeps heat losses and atmospheric exchange low. The transporting of the coils 11 to and from the rotary hearth furnace 20 is effected by means of a coil transport system 14. The coils 11 can be recalled from the furnace 20 in desired sequence. Alternatively, the rotary hearth furnace 20 can be designed for an externally arranged charging device 18.

Figure 4:
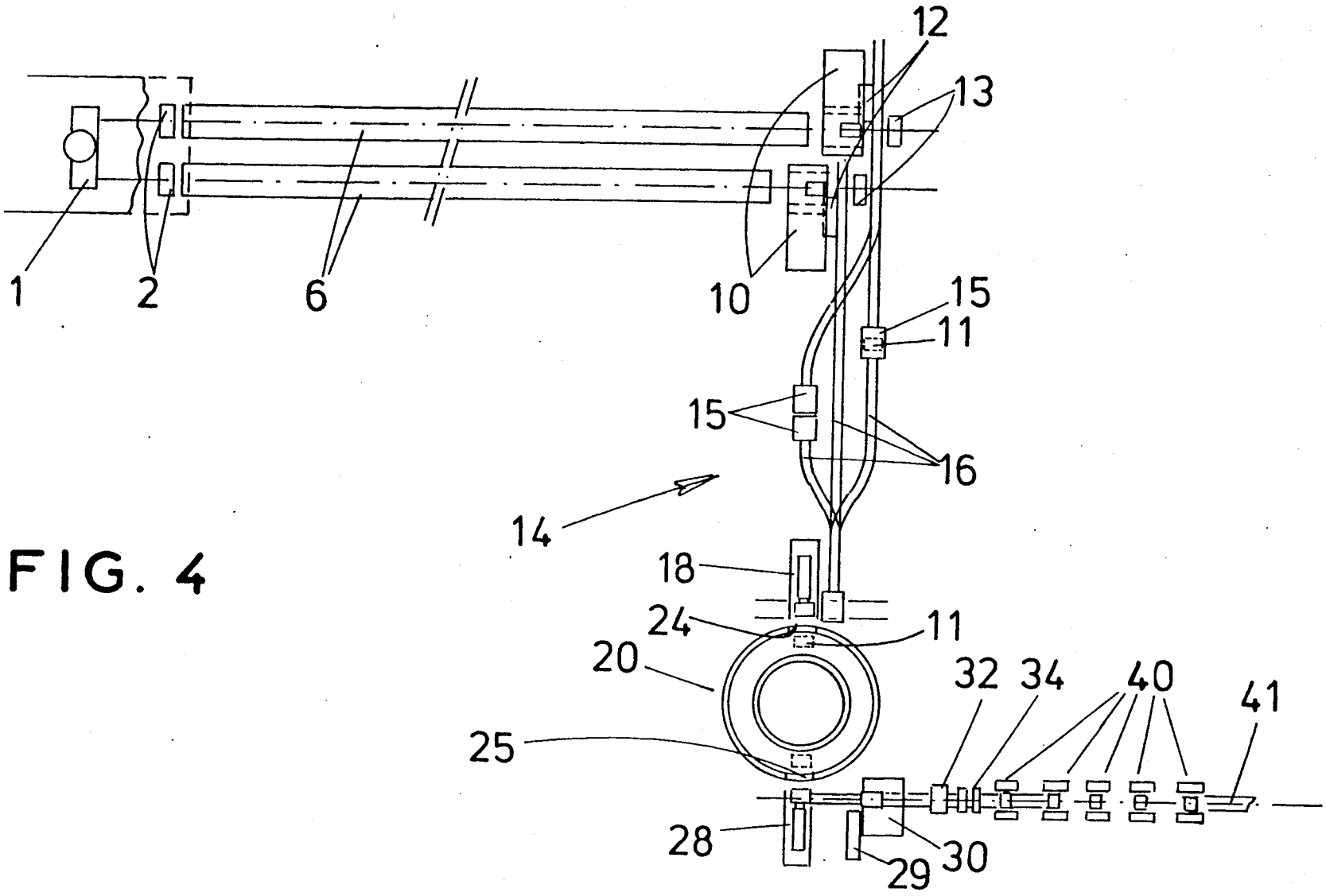
FIG. 4 hows a top view of a strip casting installation, according to the invention, with a rotary hearth furnace in the transverse connection between the pitch and casting line which are offset relative to one another.

The transporting system 14 according to FIG. 4 is particularly advisable for installations in which a greater distance must be bridged between the strip casting machines 1 and the rolling mill 40. The main area of use is therefore the conversion of conventional rolling mills into strip casting installations with an adjoining continuous rolling mill train. Hoisting stations 13 for lifting the coils 11 to the level of the transporting system 14, i.e. to the height of transporting cars 15, are provided behind the coilers 10 and the coil transfer devices 12. The cars 15 are equipped with removable heat insulating hoods which prevent high heat losses during the traveling of the coils 11 to the rotary hearth furnace 20. Each car 15 has its own drive and can be moved independently. The rail guidance 16 is dependent on the local peculiarities and project tasks. The heat insulating hoods of the cars 15 are equipped with burners, pilot burners, etc. and a temperature measurement, and can be heated or re-heated at provided places. The rotary hearth furnace 20 is arranged so as to adjoin the rail line 16 in the transporting direction, its charging openings 24, 25 lying opposite one another. The manner of operation of the device and the successive units substantially corresponds to the description relating to FIG. 1.

Figure 5:
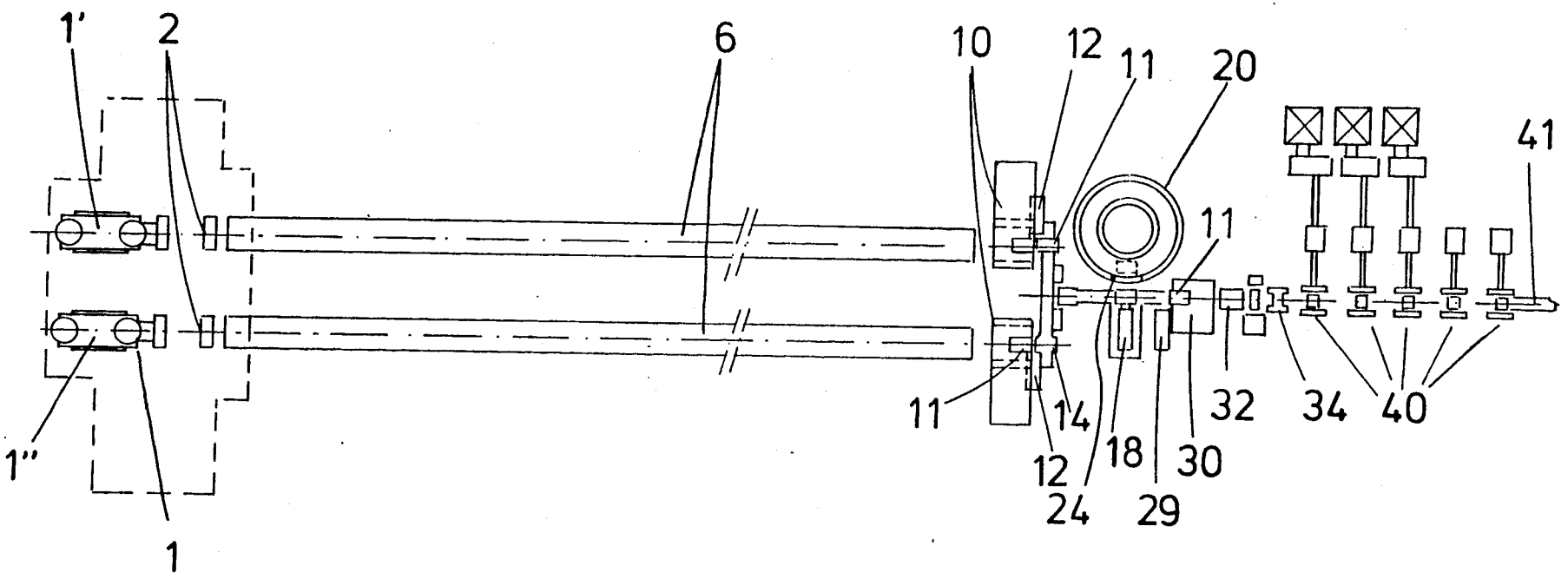
FIG. 5 shows a top view of a strip casting installation, according to the invention, with a rotary hearth furnace with only one charging and discharging opening.

The rotary hearth furnace 20 can also be arranged adjacent to the production line of the strip casting installation 1 according to FIG. 5 similar to the installation shown in FIG. 3 and in this case again serves as a pure coil storage furnace. The charging or discharging of the coils 11 is effected at the same location via the charging opening 24. Accordingly, the possibility is again provided of keeping the distances of the transporting system 14 short. The coils 11 can be recalled from the furnace 20 in desired sequence.

The steps, according to the invention, are not restricted to the embodiment examples shown in the drawings. Thus, for example, one or more rotary hearth furnaces can be provided in desired arrangement, e.g. can also be used in multiple-strand installations, without departing from the framework of the invention. Moreover, it can also be advisable to arrange the rotary hearth furnace directly behind the casting machine or the shears and to replace the previously used tunnel furnaces entirely. The respective constructional design for adapting to the specific utilization of the installation is left to the discretion of the person skilled in the art.

While the invention has been illustrated and described as embodied in a strip casting installation with a rotary hearth furnace and a method for producing hot-rolled steel strip therefrom, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. A method for producing a hot-rolled steel strip from continuously cast primary material, comprising the steps of:

dividing the continuously cast primary material into pieces of predetermined length after solidification;

bringing the pieces of primary material to hot rolling temperature in a soaking furnace;

removing the primary material and winding it up to form coils after reaching the hot rolling temperature;

intermediately storing the coils in a rotary hearth furnace;

recalling the coils as needed, and uncoiling the primary material; and introducing the primary material into a finishing train for rolling out to form finished strips.

2. A method according to claim 1, wherein said intermediately storing step is effected directly prior to entering the finishing train.

3. A method according to claim 1, wherein said intermediately storing step includes storing the coils in a horizontal position.

4. A method according to claim 1, wherein said intermediately storing step includes storing the coils with a horizontal coiling axis.

5. A method according to claim 1, wherein said intermediately storing step includes supplying heat to the coils of primary material.

6. A strip casting installation with a continuous rolling mill arranged downstream for a producing hot-rolled steel strip from a continuously cast primary material in a production line of consecutive work steps, comprising:

means for dividing the continuously cast primary material into pieces of predetermined length after solidification;

a soaking furnace arranged so as to bring the pieces of primary material to a hot rolling temperature;

finishing train means for rolling out the primary material to form finished strips;

a coiler;

a rotary hearth furnace; and an uncoiler, the coiler, the rotary hearth furnace and the uncoiler being arranged between the soaking furnace and the finishing train means.

7. An installation according to claim 6, wherein said rotary hearth furnace is provided so as to intermediately store a plurality of coils formed from parallel primary material strands.

8. An installation according to claim 6, wherein the rotary hearth furnace is integrated into the production line and includes a charging and discharging location.

9. An installation according to claim 6, wherein the rotary hearth furnace is arranged adjacent to the production line and is provided with one charging and discharging location.

10. An installation according to claim 8, wherein the second furnace has an inner circle, the charging device being arranged in the inner circle of the second furnace.

11. An installation according to claim 6, wherein the rotary hearth furnace has an outer diameter of approximately 13.5 m and is formed so as to receive ten coils.

12. An installation according to claim 6, wherein the strip casting installation is a double-strand installation, and further comprising an additional first furnace and an additional coiler, the two coilers being arranged downstream of the first furnaces.

13. An installation according to claim 6, wherein the first furnace is a shortened roller hearth furnace without a soaking zone having an induction heater arranged prior to it.

* * * * *